US009520245B2

(12) United States Patent
Tanaka et al.

(10) Patent No.: US 9,520,245 B2
(45) Date of Patent: Dec. 13, 2016

(54) CONTACT STRUCTURE

(75) Inventors: Arata Tanaka, Ryugasaki (JP); Katsuaki Suzuki, Ryugasaki (JP)

(73) Assignee: TYCO ELECTRONICS JAPAN G.K., Tokyo (JP)

( * ) Notice: Subject to any disclaimer, the term of this patent is extended or adjusted under 35 U.S.C. 154(b) by 242 days.

(21) Appl. No.: 13/884,567

(22) PCT Filed: Nov. 9, 2011

(86) PCT No.: PCT/JP2011/075842

§ 371 (c)(1),
(2), (4) Date: Jul. 23, 2013

(87) PCT Pub. No.: WO2012/063869

PCT Pub. Date: May 18, 2012

(65) Prior Publication Data

US 2013/0299323 A1 Nov. 14, 2013

(30) Foreign Application Priority Data

Nov. 10, 2010 (JP) ..... 2010-252094

(51) Int. Cl.
*H01H 1/22* (2006.01)
*H01H 1/20* (2006.01)
(Continued)

(52) U.S. Cl.
CPC ..... *H01H 1/22* (2013.01); *H01H 1/2016* (2013.01); *H01H 1/2075* (2013.01); *H01H 1/26* (2013.01);
(Continued)

(58) Field of Classification Search
CPC ..... H01H 37/52; H01H 51/22; H01H 1/22
(Continued)

(56) References Cited

U.S. PATENT DOCUMENTS 4,453,057 A 6/1984 Streich et al.
2006/0181375 A1* 8/2006 Nakatani ..... H01H 57/00 335/78
2011/0140827 A1 6/2011 Suzuki

FOREIGN PATENT DOCUMENTS

CA 2721512 A1 10/2009
CN 201503815 U 6/2010
(Continued)

OTHER PUBLICATIONS

International Search Report for International Application No. PCT/JP2011/075842, mailed Feb. 21, 2012, with English translation.
(Continued)

*Primary Examiner* — Edwin A. Leon
*Assistant Examiner* — Iman Malakooti

(57) ABSTRACT

The present invention provides a means in which contact between contacts in a "double-break (or double-make) contact structure" occurs in two places in the same state as much as possible. A contact structure includes two fixed members (110,112) each of which has a fixed contact (116,118) and a movable member (102) containing a movable contact (106) which contacts or separates from the fixed contact of each of the fixed members. The movable member is in the form of a strip as a whole, its one end is supported so as to allow the above mentioned contact and separation of the movable member, and the other end of the movable member has the movable contact, and the movable member has a narrowed section between its two ends.

6 Claims, 3 Drawing Sheets

(51) Int. Cl.

| | |
|---|---|
| *H01H 1/26* | (2006.01) |
| *H01H 37/54* | (2006.01) |
| *H01H 81/02* | (2006.01) |
| *H01H 1/24* | (2006.01) |

(52) U.S. Cl.
CPC ..... *H01H 37/5418* (2013.01); *H01H 81/02* (2013.01); *H01H 2001/247* (2013.01)

(58) Field of Classification Search
USPC ..... 200/244; 335/78; 337/362
See application file for complete search history.

(56) References Cited

FOREIGN PATENT DOCUMENTS

| | | | |
|---|---|---|---|
| DE | 3232679 | A1 | 3/1983 |
| JP | 2006-294591 | A | 10/2006 |
| JP | 2008-177074 | A | 7/2008 |
| WO | WO-2009/128535 | A1 | 10/2009 |

OTHER PUBLICATIONS

Supplementary European Search Report for European Application No. EP 11840039, dated Oct. 15, 2014.
Search Report for Chinese Application No. 201180064305.3, dated Jan. 26, 2015.
Search Report for Taiwanese Patent Application No. 100141008, dated Apr. 21, 2015.
Second Office action and Search Report for Chinese Application No. 201180064305.3, dated Dec. 9, 2015.

* cited by examiner

CONTACT STRUCTURE

FIELD OF THE INVENTION

The present invention relates to a double-break (or a double-make) contact structure used in a switch such as a relay, a circuit breaker, and the like, and a circuit protection device comprising such a contact structure.

BACKGROUND OF THE INVENTION

In a switch such as a relay, and the like, various types of contacts are used. Among those contacts, a double-break (or a double-make) contact structure is extensively used. As used herein, the "double-break (or double-make) contact structure" means a contact structure which has a function wherein a contact provided on a section functioning as a movable terminal of one movable member (i.e. a movable contact) mechanically contacts with a contact provided on a section functioning as a fixed terminal (i.e. a fixed contact) in each of two fixed members to form two electric connections (i.e. a double-make part), thereby closing an electric circuit between the movable member and the fixed members; and also has a function wherein, from the above mentioned contacting state of the contacts, the contact of the movable member is separated from the contacts of the fixed members to form two electric non-connections (i.e. double-break parts), thereby opening the electric circuit between the movable member and the fixed members. That is, a contact structure in which there are two contact pairs which can take reversibly the contacting state or the non-contacting state is called as the double-break (or double-make) contact structure.

It is noted that such contacts as mentioned above may be in any suitable forms provided on sections which function as terminals of the movable member and the fixed member, usually on their end portions. For example, they may be in various forms of protruding portions, flat plates or portions of such flat plates. In one embodiment, the contact provided on the fixed member is a protrusion, for example, a portion of a sphere (for example, a hemispherical protrusion), and the contact provided on the movable member is a flat plate. In other embodiment, the contact provided on the fixed member may be a flat plate, and the contact provided on the movable member may be a protrusion. It is noted that when the contact is a flat plate, it is possible that no separate plate is provided, but the terminal itself has a function as a contact. It is noted that the contact provided on the movable member may be in a single form which is integrally connected to the movable member by means of an electrically conductive material, and in particular, the contact may be in the form of an elongated and flat strip provided on the movable member. Furthermore, the strip may be provided with a protrusion(s).

In such "double-break (or double-make) contact structure", a length of its air-gap is doubled in comparison with that of the air-gap of a single-break contact structure having one contact pair. Therefore, such contact structure is said to have an advantage of causing less fusion likelihood between the contacts because energy of arc which is generated when a circuit is opened is dispersed into two air-gaps. Thus, such contact structure is extensively used.

For example, WO 2009/128535 proposes a circuit protection device which uses the above mentioned "double-break (or double-make) contact structure". This device comprises a circuit switching member having a bimetal component as a circuit switching element and a movable contact as well as a PTC member. This circuit protection device is constructed such that, in a state wherein each of two movable contacts and each of two fixed contacts are in contact respectively (i.e. the double-make state) and a current is flowing through a circuit, when an excess current flows through the circuit, for example, due to occurrence of some abnormal state and a temperature of the bimetal component exceeds its threshold temperature, a state wherein the movable contacts are displaced to be separated from the fixed contacts (i.e. a double-break state) by the deformation of the bimetal component, thereby opening the circuit to protect the circuit and/or an electrical apparatus incorporated into the circuit. Then, when the abnormal state is resolved, the temperature of the bimetal component is decreased to return to its original shape, so that the movable contacts and the fixed contacts are in contact at two positions to flow the current through the circuit again.

In order that such a circuit protection device adequately provides a circuit protection function, it is necessary to allow contact and separation between the contacts to sufficiently and surely arise at two positions by the deformation of the bimetal component.

International Publication No. WO 2009/128535 is a prior patent reference.

SUMMARY OF THE INVENTION

In the above mentioned "double-break (or double-make) contact structure", the movable contact is usually provided on an end portion of a metal strip as a movable member which portion functions as a movable terminal. When the circuit protection device is intended to be made more compact, it is desired that the distance between the fixed terminals (or the fixed contacts) is shortened as much as possible. In this case, a width of the movable member shortens at the same time. As the result, there is a possibility that contacts between the contacts are not sufficiently or surely formed at two positions, that is, a so-called "partial contact (or one side contact)" state can arise. In this case, there is a problem of being able to increase a contact resistance between the contacts at one position.

Therefore, a problem to be solved by the present invention is to provide a means with which contacting states between contacts are formed at two positions in the same states as much as possible in the "double-break (or double-make) contact structure".

In a first aspect, the present invention provides a contact structure (in particular, a double-break (or double-make) contact structure) comprising two fixed members, each of which has a fixed contact, and a movable member comprising a movable contact which contacts or separates from the fixed contact of each of the fixed members, characterized in that the movable member is in the form of a strip as a whole, its one end portion is supported so as to allow the movable member to contact or separate as mentioned above, and the other end portion of the movable member has the movable contact, and the movable member has a narrowed (or constricted) section between the both of the two end portions, such contact structure is able to be used in a circuit protection device.

As used herein, the term "in the form of a strip" means a form of a rectangle shape, preferably an elongated rectangle shape, and its thickness is less than the other dimensions (length and width), usually negligible. Therefore, in the specification of the present application, the thickness of the movable member is ignored as to the description of the present invention. Though the form of the strip means, for example, an elongated rectangle shape, sides which define this shape are not necessarily straight lines, and it is sufficient that they only have to provide an elongated rectangle shape in a macroscopic appearance. For example, the sides defining this shape may be a combination of a straight line and a curve line. It is noted that the elongated rectangle shape means in which a length of a long side of the rectangle is at least double length that of a short side of the rectangle.

The term "(be) in the form of a strip as a whole" means that, when it is assumed that the narrowed section is ignored or the narrowed section is absent, the movable member is in the form of a strip as mentioned above. The term "narrowed section" means that a section of which dimension perpendicular to a long side which defines the strip under the above mentioned assumption (i.e. a short side of the strip), that is, its width is smaller than the long side length. It is noted that the narrowed section is present between the both ends of the strip shape, not at the end. Such narrowed section is preferably formed such that the width of the strip recedes (or dents) by the same distance from the both edges (i.e. the long sides) at a predetermined position in direction of the length of the strip.

One embodiment of a movable member 10 constructing the contact structure of the present invention is schematically shown in a plan view in FIG. 1. As illustrated, there is a narrowed section 16 between two ends 12 and 14 of the movable member. If this movable member 10 had no narrowed section 16, that is, when parts shown by dotted lines 18 and 20 are assumed to be portions of the outer edges of the movable member, the movable member 10 has an elongated shape, for example, the movable member 10 is in the form of an elongated rectangle shape or a rectangle shape. Therefore, the movable member 10 is in the form of a strip as a whole.

The narrowed section 16 has a dimension perpendicular to a long side 22 of the strip (i.e. a dimension in direction of a short side 24 of the strip), that is, a width "a". The width "a" is smaller than a width "b" of a section other than the narrowed section. In other words, the narrowed section is formed by indenting a portion of each of the opposite long sides of the strip form, that is, by forming concave portions 26. The shape of the concave portion 26 (including the portion of the dotted line here) may be in any suitable form, and for example, as illustrated, may be in the form of a rectangle or a square. Alternatively, it may be in the form of a triangle, a semicircle or a trapezium, and the lines constituting these shapes may be a straight line(s) as illustrated or a curved line(s). Furthermore, in other embodiment, the shape of the concave portion 26 may be any combination of the various shapes as described above. In one embodiment of the present invention, the shape of the concave portion is preferably a rectangle, a trapezium, a triangle, or a semicircle.

It is noted that the shape of the narrowed section, the position of the narrowed section (a position of a central part of the narrowed section with respect to the length "L" of the movable member in FIG. 1), the width "a" of the narrowed section, the depth "c" of the narrowed section (lengths c1 and c2 in FIG. 1, which are preferably the same), the length "d" of the narrowed section (see FIG. 2, corresponding to the length of the dotted line in FIG. 1), and the like can be appropriately selected depending on the movable member to be used, in particular depending on a material constituting the movable member, the length "L" of the movable member, the width "b" of the movable member, and the like. For example, the width "a" of the narrowed section is preferably 0.3-0.6 times the width "b" of the movable member, and the length "L" of the movable member is preferably 2-4 times the width "b".

In one specifically preferable embodiment, the following narrowed section is preferable:

Material of movable member: material having both of a high strength and an excellent springiness (for example, made of a beryllium copper);

Length "L" of movable member: 15 mm (±10 mm);

Width "b" of movable member: 10 mm (±7 mm);

Shape of narrowed section: rectangle or trapezium;

Position of narrowed section: it is preferable to be nearer to the movable contact (for example, the movable contact 106 in FIG. 2) (for example, the position, for example, 0.05 L-0.4 L, in particular 0.1 L-0.3 L from the end of the movable member which end functions as the movable terminal of the movable member);

Width "a" of narrowed section: it is preferable to be small as much as possible (for example, a:b=about 0.5-2:2-4, for example, a:b=about 1:3);

Depth "c" of concave portion (the length "c1" (="c2") in FIG. 1): it is selected such that the narrowed section is located in the center of the width direction of the movable member;

Length d of the narrowed section: 0.5 mm or more (for example, 0.5 mm-15 mm, preferably 2 mm-12 mm, and more preferably 3-10 mm); and Thickness of movable member: 0.15 mm (±0.05 mm).

In further embodiment, the above "L", "a" and "b" have dimensions as follows:

Embodiment (1) L: 16.4 mm, b: 4.4 mm, a: 1.5 mm

Embodiment (2) L: 22.0 mm, b: 11.0 mm, a: 8.0 mm

Embodiment (3) L: 25.0 mm, b: 11.0 mm, a: 7.0 mm.

In a second aspect, the present invention provides a circuit protection device which comprises the contact structure above and below mentioned wherein the device comprises a circuit switching member which comprises a bimetal component as a circuit switching element and a movable terminal having a movable contact as well as and a PTC component, which device is characterized in that (1) the PTC component and the movable terminal are electrically connected in parallel;

(2) the circuit switching member is able to interrupt a current flowing through the circuit switching member by moving the movable terminal disposed to pass the current so that the movable contact is separated from the fixed contacts by actuation of the bimetal component at its actuating temperature (Top), and is also able to pass, by resetting of the bimetal component at its reset temperature (Tcl), the current through the circuit switching member by moving the movable terminal disposed to interrupt the current so that the movable contact becomes in contact with the fixed contacts; and (3) the bimetal component is disposed between the PTC component and the movable terminal.

In one preferable embodiment of the above mentioned circuit protection device, (4) the actuating temperature (Top) of the bimetal component is at least 20° C. higher than the reset temperature (Tcl); and/or (5) a trip temperature (Ttr) of the PTC component is at least 10° C. higher than the actuating temperature of the bimetal component.

Furthermore, the present invention also provides an electrical circuit (having a concept also including an electronic circuit) comprising such circuit protection device, and further provides an electrical apparatus (having a concept also including an electronic apparatus) comprising such electrical circuit.

In the contact structure of the present invention, it is facilitated that each part of the movable member located on either side of the narrowed section rotates about the longitudinal axis of the movable member in a direction opposite relatively to each other doe to the presence of the narrowed section. As a result, when a situation arises in which one pair of the movable contact and the fixed contact is in contact, and the other pair of the movable contact and the fixed contact is not in contact (i.e. in the case of the "partial contact" state), the fixed contact of such the contact pair presses the movable contact, and by its pressure, the part of the movable member on which the movable contact is located rotates as mentioned above. In consequence, the movable contact which had not been in contact yet gets close to and eventually contacts the fixed contact.

When the narrowed section is present, a force needed for rotating as mentioned above, i.e. a force for moving the movable contact closer to the fixed contact becomes smaller. Therefore, when the "partial contact" state is likely to arise, its occurrence can easily be prevented. As a result, even if the distance between the fixed terminals in the contact structure is reduced, the partial contact can be suppressed as much as possible, thus the circuit protection device can be made more compact.

DETAILED DESCRIPTION OF THE INVENTION

Figure 1:
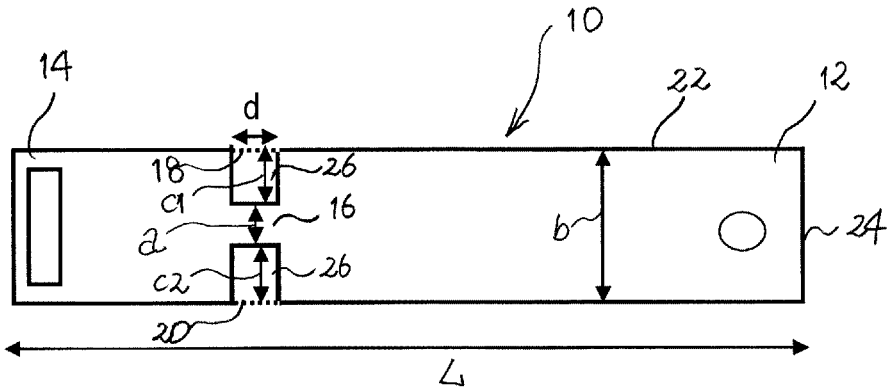
FIG. 1 shows schematically as a plan view one embodiment of the movable member constituting the contact structure of the present invention.
Figure 2:
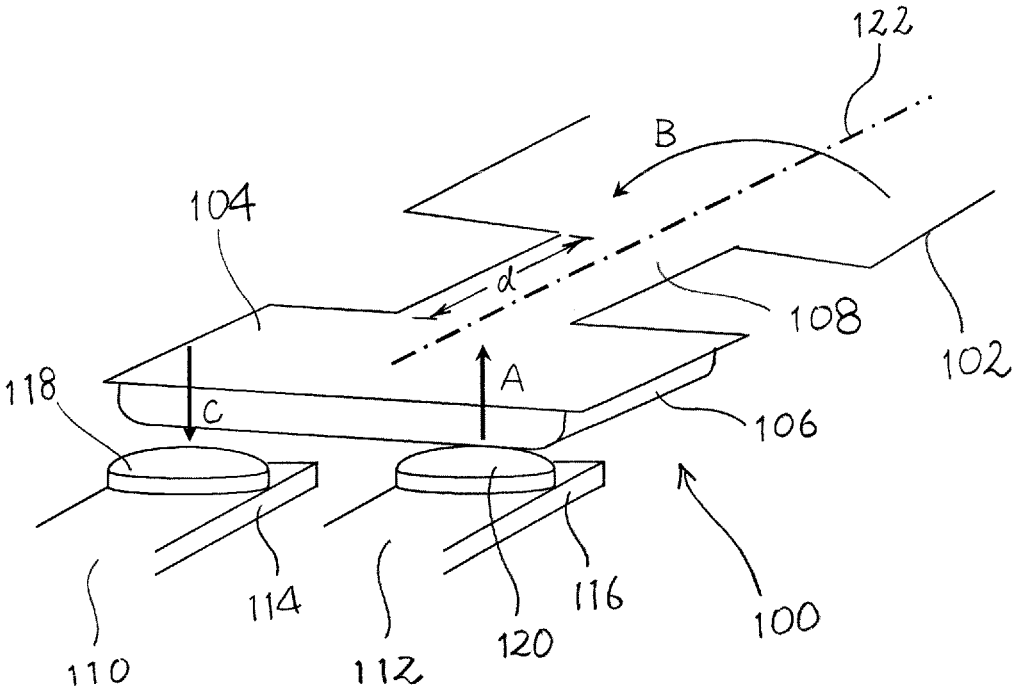
FIG. 2 shows schematically as a perspective view one embodiment of the contact structure of the present invention.

A contact structure 100 of the present invention is shown in FIG. 2 as a perspective view. A movable member 102 has a movable contact 106 which is disposed on its one end and functions as a movable terminal 104, and a narrowed section 108 which is disposed posterior to the movable terminal 104. It is noted that the thickness of the movable member is ignored in the Figure.

Two fixed members 110 and 112 are disposed below the movable terminal 104, and fixed contacts 118 and 120 are disposed on one ends of the respective fixed members respectively which contacts function as fixed terminals 114 and 116.

Each of the respective fixed contacts 118 and 120 can contact the movable contact 106 opposing thereto and also can be separated from such contact state by a force acting on the movable member (i.e. a force acting to move the movable terminal closer to the fixed terminal) and an opposite force thereto, respectively. It is noted that, in the illustrated embodiment, the movable contact is in the form of a single part, and two movable contacts may be provided on the movable terminal so that they are opposite to the fixed contacts, respectively.

Essentially, the illustrated movable terminal 104 and the illustrated fixed terminals 114 and 116 are constituted such that when a force acts to make them get closer to each other (for example, when a downward force acts on the movable terminal 104 so that it gets closer to the fixed terminals 114 and 116), the contacts provided on the members sufficiently get in contact with each other. However, the sufficient contact cannot always be ensured because of, for example, a force applied during a manufacturing step of the contact structure or its following step in which the structure is handled.

Normally, though both contacts are expected to be in contact with each other when it is intended to pass a current from the fixed terminal 110 to the fixed terminal 112 via the movable terminal 104. However, as illustrated, a situation may occur in which the fixed contact 118 is a little away from the movable contact 106 while the fixed contact 120 is in contact with the movable contact 106. In this situation, it is impossible to pass the current.

However, according to the contact structure of the present invention, after the fixed contact 120 contacts the right side of the movable terminal 106, when a downward force further acts on the movable terminal 104, a upward force acts such that the right side of the movable terminal 106 is pushed upward as shown with an arrow "A". At this time, the movable terminal can easily rotate about the longitudinal axis of the movable member 122 as shown with an arrow "B" due to the presence of the narrowed section 108. Then, a force which pushes the left side of the movable terminal 106 downward as shown with an arrow "C". As a result, the left side of the movable terminal 106 contacts the fixed contact 118.

As understood, the longer the length "d" of the narrowed section 108 and the smaller the width "a" of the narrowed section, the smaller the force needed to rotate the movable terminal 104. However, when the width "a" is excessively small and/or the length "d" is excessively long, the narrowed section 108 cannot strongly and integrally connect the movable member disposed posterior thereto to the movable terminal 104 and hold them. Therefore, as mentioned above, the length "d" and the width "a" of the narrowed section can be appropriately selected depending on the material of the movable member to be used, the length "L" of the movable member, the width "b" of the movable member, the shape and the position of the narrowed section, and a force acting on the movable terminal (for example, the force shown with the arrow "A" in FIG. 2).

Figure 3:
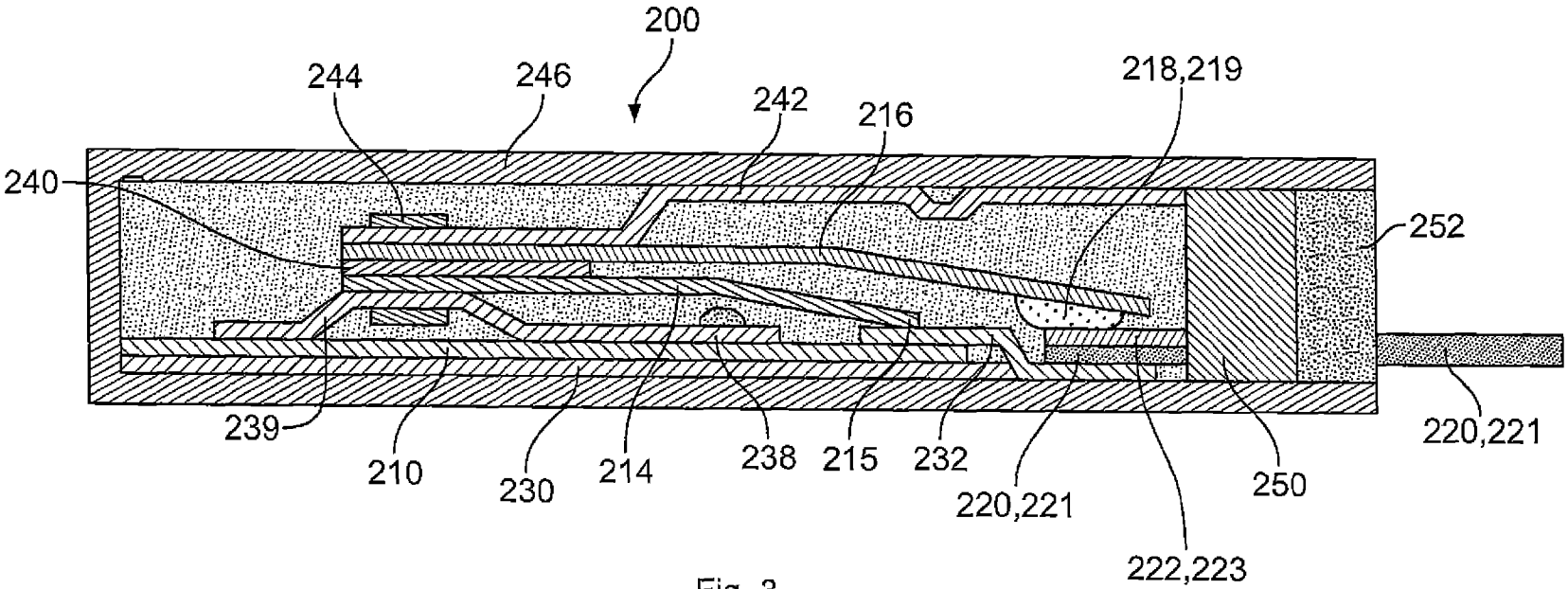
FIG. 3 shows schematically as a cross-section view one embodiment of a circuit protection device of the present invention which comprises the contact structure of the present invention.
Figure 4:
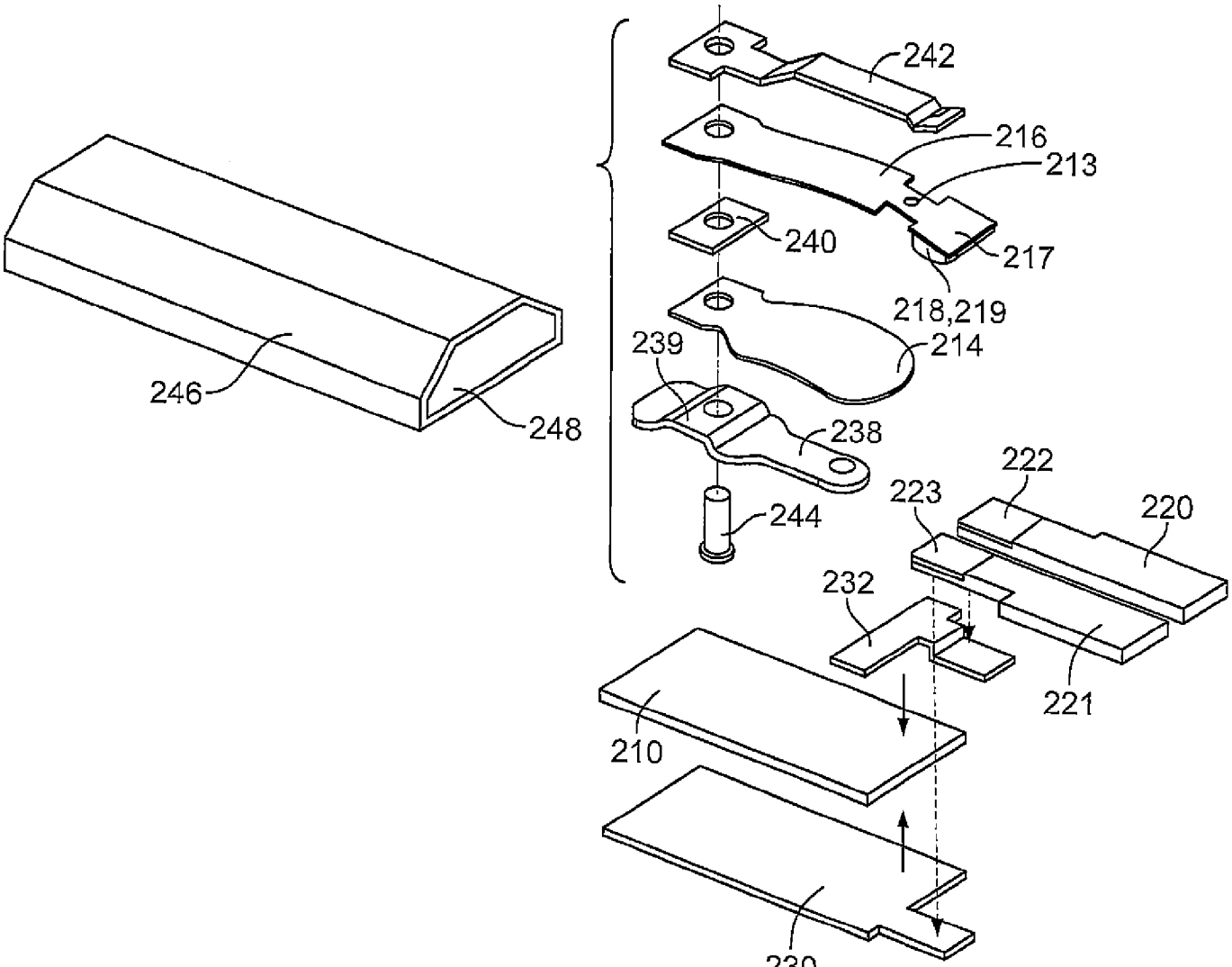
FIG. 4 shows schematically as an exploded perspective view the circuit protection device of the present invention shown in FIG. 3.

A cross-section view of one embodiment of a circuit protection device which comprises the contact structure of the present invention, that is, the circuit protection device of the present invention is schematically shown in FIG. 3, and additionally, its exploded perspective view is schematically shown in FIG. 4. The circuit protection device 200 of the present invention shown in the Figures comprises a circuit switching member which comprises a bimetal component as a circuit switching element and a movable member as well as and a PTC component, which device is characterized in that (1) the PTC component and the circuit switching member are electrically connected in parallel;

(2) the circuit switching member is able to interrupt a current flowing through the circuit switching member by moving the movable terminal disposed to pass the current (in particular, the movable contact disposed thereon) so that it is separated from the fixed terminal (in particular, the fixed contacts disposed thereon) by actuation of the bimetal component at its actuating temperature (Top), and is also able to pass the current therethrough by resetting of the bimetal component at its reset temperature (Tcl), that is, is able to pass the current through the circuit switching member by moving the movable terminal disposed to interrupt the current (in particular, the movable contact disposed thereon) so that the movable terminal becomes in contact with the fixed terminal (in particular, the fixed contacts disposed thereon).

In the illustrated circuit protection device 200, a lower side lead 230 and an upper side lead 232 are disposed on a lower side and an upper side of a PTC component 210, respectively. These are electrically connected by, for example, soldering. Further, fixed members 221 and 220 are electrically connected to these leads 230 and 232, respectively, by for example, resistance welding or ultrasound welding. One end (a right side section in FIG. 3) of each of the fixed members 220 and 221 is connected to a terminal or the like of a prescribed electric circuit, so that the circuit protection device is disposed in series in the electrical circuit.

It is noted that the PTC component used in the circuit protection device may be a conventional PTC component which is itself used as a so-called circuit protection device and generally comprises a laminated electrically conductive PTC element and metal electrodes disposed on its both sides. The electrically conductive PTC element may be made of a ceramic or of a polymer material. A particularly preferable PTC component is a so-called polymeric PTC component, and a PTC component may be suitably used which comprises an electrically conductive polymer element wherein electrically conductive fillers (for example carbon, nickel, nickel-cobalt fillers) are dispersed in a polymer material (for example a polyethylene, a polyvinylidene fluoride, etc.).

A base plate 238 is also disposed on the PTC component 210. In the illustrated embodiment, the base plate 238 has a portion 239 that protrudes upwards; a bimetal component 214, a spacer 240, a movable member 216, and an upper plate 242 are disposed in thus mentioned order over this portion 239. These are integrated by swaging them with a pin 244 as illustrated. It is noted that the connection between the base plate 238 and the PTC component 210 may be performed by any appropriate method; it may, for example, be performed by a soldering connection.

In the illustrated embodiment, the movable member 216 has a strip structure as a whole. Its one end functions as a movable terminal 217, and the other end functions such that the movable terminal is integrated with other members to support (or fix) it as mentioned above. The movable member 216 has a narrowed section 213 between those ends. The bimetal component 214 changes in its shape (i.e. curves) by heat so as to change the position of its tip 215 upward or downward, thereby the movable member 216 is curved or transforms toward the original shape, and as the result, the position of the movable terminal 217 moves up or down.

In the embodiment shown in FIG. 3, the bimetal component 214 is in a reset state (i.e. the electrical circuit is functioning normally). The tip 215 of the bimetal component 214 is separated from the movable terminal 216. It is noted that, in the illustrated embodiment, the movable member 216 is in a state of being trying to return toward its original shape. As a result, the movable contacts 218 and 219 disposed on a tip of the movable member which tip functions as the movable terminal 217 are in contact with contacts 222 and 223 which are disposed on left side ends of the fixed members 220 and 221, and function as the fixed terminals. Therefore, when the circuit protection device in thus mentioned state is disposed in an electrical circuit (not illustrated) and a current flows through the circuit, the current flows in the order of the fixed member 220→the fixed contact 222→the movable contact 219→the movable contact 218→the fixed contact 223→the fixed terminal 221.

In the illustrated embodiment, resilience of an electrically conductive metal material of the movable member 216, and a force to make to move the movable member 217 downward (a force in the direction opposite to the arrow "A" shown in FIG. 2) are acted wherein the force is generated by being kept the movable member in the illustrated shape which is different from its original shape, that is, the movable member is held as illustrated, though the movable member is trying to return to its original shape. If only one pair of the fixed contact and the movable contact get in contact as shown in FIG. 2, a force acts at such contact position in the direction of the arrow "A" shown in FIG. 2 so that the other pair of the contacts is able to be in contact with each other.

In the illustrated embodiment, when an abnormality occurs in the electrical circuit and an excess current flows, a temperature in the proximity of the movable terminal 217 of the movable member 216 rises. Then, the temperature of the movable member 216 rises, while the heat is transferred to the bimetal component 214 so that the bimetal component 214 actuates. As a result, the bimetal component 214 inverts so that its tip 215 bends upward to raise the movable terminal 217; and the contact state between the movable contacts 218 and 219 and the fixed contacts 223 and 222 is lost, that is, the electrical connection between the fixed contact 222 and the movable contact 219, and the electrical connection between the fixed contact 223 and the movable contact 218 are broken. In such a state, when the PTC component 210 is not yet in a tripped state, and its resistance is sufficiently low, the current flows in the order of the fixed member 220→the upper side lead 232→the PTC component 210→the lower side lead 230→the fixed member 221, thereby being diverted.

When there is no change in the abnormality of the electrical circuit, the excess current flows through the PTC component 210, whereby the PTC component 210 trips thereafter. As the result, the current flowing through the electrical circuit is substantially interrupted so that the electrical circuit can be protected. It is noted, as can be easily understood from the above mentioned descriptions, that the circuit switching member in the circuit protection device of the present invention is of a non-current carrying type circuit switching member, wherein the current flows through the movable terminal and/or the movable contacts provided thereon and the current does not flow through the bimetal component itself.

As shown in FIG. 3 and FIG. 4, it is noted that the above mentioned circuit protection device 200 of the present invention is inserted inside a casing 246 through its opening 248; the opening is sealed with an insulating resin 250 and an adhesive 252.

THE ELEMENT REFERENCE NUMERALS ARE

10—movable member which constitutes contact structure;
12,14—end;
16—narrowed section;
18, 20—dotted line part;
22—long side;
24—short side;

26—concave portion;
"a"—width of narrowed section;
"b"—width of movable member;
"c"—depth of narrowed section;
"d"—length of narrowed section;
100—contact structure;
102—movable member;
104—movable terminal;
106—movable contact;
108—narrowed section;
110, 112—fixed member;
114, 116—fixed terminal;
118, 120—fixed contact;
122—longitudinal axis of movable member;
200—circuit protection device;
210—PTC component;
213—narrowed section;
214—bimetal component;
215—tip of bimetal component;
216—movable member;
217—movable terminal;
218,219—movable contact;
220, 221—fixed member;
222,223—fixed contact;
230—lower side lead;
232—upper side lead,
238—base plate;
240—spacer;
242—upper plate;
244—pin;
246—casing;
248—opening;
250—insulating material;
252—adhesive

What is claimed is:

1. A circuit protection device which comprises a contact structure, said contact structure comprising two fixed members each of which has a fixed contact, and a movable member comprising a movable contact which contacts or separates from the fixed contact each fixed member, which structure is characterized in that:

the movable member is in the form of a strip as a whole having edges along a length and a width between the edges, its one end is supported so as to allow said contacting and separating of the movable member, and the other end of the movable member has the movable contact, the movable member has a narrowed section between its two ends, said narrowed section having a width that is 0.3 to 0.6 times a width of the movable member and is formed such that the width of the movable member recedes by the same distance from the edges, and the circuit protection device comprises a circuit switching member comprising a bimetal component as a circuit switching element and a movable terminal having the movable contact, and a PTC component.

2. The circuit protection device according to claim 1 characterized in that (1) the PTC component and the movable terminal are electrically connected in parallel;

(2) the circuit switching member is able to interrupt a current flowing through the circuit switching member by moving the movable terminal which is disposed to pass the current so as to separate the movable contact from the fixed contacts by means of actuation of the bimetal component at its actuating temperature (Top), and is also able to pass the current through the circuit switching member by contacting the movable contact with the fixed contacts through moving the movable terminal which is disposed to interrupt the current by means of resetting of the bimetal component at its reset temperature (Tcl), and (3) the bimetal component is disposed between the PTC component and the movable terminal.

3. An electrical apparatus which comprises a circuit protection device, said circuit protection device comprising a contact structure, said contact structure comprising two fixed members each of which has a fixed contact, and a movable member comprising a movable contact which contacts or separates from the fixed contact each fixed member, which structure is characterized in that the movable member is in the form of a strip as a whole having edges along a length and a width between the edges, its one end is supported so as to allow said contacting and separating of the movable member, and the other end of the movable member has the movable contact, and the movable member has a narrowed section between its two ends, said narrowed section having a width that is 0.3 to 0.6 times a width of the movable member and is formed such that the width of the movable member recedes by the same distance from the edges, wherein the circuit protection device comprises a circuit switching member comprising a bimetal component as a circuit switching element and a movable terminal having the movable contact, and a PTC component.

4. The circuit protection device of claim 1 wherein the contact structure is a double-break or double-make contact structure.

5. The electrical apparatus of claim 3 wherein (1) the PTC component and the movable terminal are electrically connected in parallel;

(2) the circuit switching member is able to interrupt a current flowing through the circuit switching member by moving the movable terminal which is disposed to pass the current so as to separate the movable contact from the fixed contacts by means of actuation of the bimetal component at its actuating temperature (Top), and is also able to pass the current through the circuit switching member by contacting the movable contact with the fixed contacts through moving the movable terminal which is disposed to interrupt the current by means of resetting of the bimetal component at its reset temperature (Tcl), and (3) the bimetal component is disposed between the PTC component and the movable terminal.

6. The electrical apparatus of claim 3 wherein the contact structure is a double-break or double-make contact structure.

* * * * *